US010234255B2

(12) United States Patent
Adjemian et al.

(10) Patent No.: US 10,234,255 B2
(45) Date of Patent: Mar. 19, 2019

(54) PROXIMITY FUZE, AND PROJECTILE PROVIDED WITH SUCH A PROXIMITY FUZE

(71) Applicants: THALES, Courbevoie (FR); JUNGHANS T2M SAS, La Ferte Saint-Aubin (FR)

(72) Inventors: Christian Adjemian, La Ferte Saint-Aubin (FR); Max Perrin, La Ferte Saint-Aubin (FR); Pascal Rousseau, Elancourt (FR); Ludovic Perruchot, Elancourt (FR); François Hugues Gauthier, Elancourt (FR)

(73) Assignees: THALES, Courbevoie (FR); JUNGHANS T2M SAS, La Ferte Saint-Aubin (FR)

( * ) Notice: Subject to any disclaimer, the term of this patent is extended or adjusted under 35 U.S.C. 154(b) by 0 days.

(21) Appl. No.: 15/306,029

(22) PCT Filed: Apr. 17, 2015

(86) PCT No.: PCT/EP2015/058405

§ 371 (c)(1),
(2) Date: Oct. 21, 2016

(87) PCT Pub. No.: WO2015/162062

PCT Pub. Date: Oct. 29, 2015

(65) Prior Publication Data

US 2017/0045347 A1 Feb. 16, 2017

(30) Foreign Application Priority Data

Apr. 25, 2014 (FR) ..... 14 00973

(51) Int. Cl.
*F42C 13/02* (2006.01)
*F42B 12/34* (2006.01)

(52) U.S. Cl.
CPC ..... *F42C 13/023* (2013.01); *F42B 12/34* (2013.01)

(58) Field of Classification Search
CPC ..... F42C 13/02; F42C 13/023; F42C 30/006; F41G 7/22; F41C 9/148
(Continued)

(56) References Cited

U.S. PATENT DOCUMENTS 2,060,200 A * 11/1936 Hammond, Jr. ..... F42C 13/023 114/21.1
2,457,393 A * 12/1948 Muffly ..... F41G 7/2253 102/213
(Continued)

FOREIGN PATENT DOCUMENTS

| | | |
|---|---|---|
| DE | 37 05 978 A1 | 9/1988 |
| EP | 0 314 646 A2 | 5/1989 |
| WO | 2011/066164 A1 | 6/2011 |

*Primary Examiner* — Samir Abdosh
(74) *Attorney, Agent, or Firm* — Baker & Hostetler LLP

(57) ABSTRACT

A fuze for detecting an obstacle in proximity, an obstacle in proximity defined as being an obstacle exhibiting a minimum distance from the fuze, wherein the fuze comprises at least: an emission device emitting a light beam directed forward of the fuze; a reception device detecting the luminous fluxes in a cone directed forward of the fuze, the light beam and the cone having relative orientations such that they cross one another; a detection volume being the volume where the light beam crosses the cone so that when an obstacle is in the detection volume, the light emitted by the emission device is backscattered toward the detection device, an obstacle in proximity being detected by detecting the maximum of backscattered power, the reception cone is centered on the axis of the fuze.

12 Claims, 5 Drawing Sheets

(58) Field of Classification Search
USPC ..... 102/211, 213
See application file for complete search history.

(56) References Cited

U.S. PATENT DOCUMENTS 3,141,411 A * 7/1964 Menke ..... F41G 7/222 102/352
3,455,243 A * 7/1969 Martin ..... F41G 7/2246 102/213
3,554,129 A * 1/1971 Alpers ..... G01S 17/46 102/213
3,642,233 A * 2/1972 Bezerie ..... F41G 7/222 102/213
3,741,111 A * 6/1973 Brenner ..... F42C 13/02 102/213
3,749,918 A * 7/1973 Jones ..... G01S 7/491 250/208.6
3,935,818 A * 2/1976 Johnson ..... F41G 7/2213 102/213
4,030,420 A * 6/1977 Skagerlund ..... F42C 13/04 102/211
4,213,394 A * 7/1980 Brenner ..... F42C 13/023 102/213
4,306,500 A * 12/1981 Castanien ..... G01S 17/87 102/213
4,409,900 A * 10/1983 Currie ..... F42C 13/023 102/213
4,709,142 A * 11/1987 Dahl ..... F42C 13/023 102/213
4,809,611 A * 3/1989 Esplin ..... F42C 13/02 102/213
4,896,606 A * 1/1990 De Coi ..... G01S 17/026 102/213
5,601,024 A * 2/1997 Sepp ..... F42C 13/023 102/213
7,286,213 B2 * 10/2007 Bredy ..... F41G 5/08 342/114
8,757,064 B2 * 6/2014 Jennings ..... F42C 13/02 102/211

* cited by examiner

PROXIMITY FUZE, AND PROJECTILE PROVIDED WITH SUCH A PROXIMITY FUZE

CROSS-REFERENCE TO RELATED APPLICATIONS

This application is a National Stage of International patent application PCT/EP2015/058405, filed on Apr. 17, 2015, which claims priority to foreign French patent application No. FR 1400973, filed on Apr. 25, 2014, the disclosures of which are incorporated by reference in their entirety.

FIELD OF THE INVENTION

The present invention relates to a proximity fuze, in particular able to be fitted to medium caliber munitions. It also relates to a projectile fitted with such a proximity fuze.

BACKGROUND

Attack helicopters are generally fitted with a medium caliber cannon placed in a nose turret. The munitions used are fitted with an impact fuze initiating the explosive charge of the shell in contact with the target or the ground. On impact with the ground the shell inevitably buries itself before being detonated, even if the delay is small. This configuration leads to considerable loss of effectiveness, all the more so when the explosive charge is relatively small.

A solution for increasing the effectiveness is to trigger detonation before impact, in proximity to the target or the ground, by fitting the explosive projectile with a proximity fuze.

Having regard to the particular configuration of firing from a helicopter, at low altitude, this proximity fuze must be compatible with very grazing firing trajectories. Moreover, the munition must be totally autonomous, without requiring any interaction with the weapons system.

The need for a munition that operates totally independently of a weapons system prohibits certain technical solutions such as those based on a chronometric function, for example a programmable-time function termed "airburst". This type of chronometric solution requires that the munition be programmed. Moreover, the chronometric principle exhibits a major drawback. This drawback is limited precision, which is incompatible with the effectiveness of medium caliber munitions for which the precision sought is of the order of a few tens of centimeters for a nominal detection distance of between 0.5 meter and 2 meters in particular.

There is therefore a need to produce a proximity detection device, or proximity fuze:

- That can be integrated into a 30-mm caliber ogive fuze, in particular;
- That is totally autonomous, requiring no integration into a weapons system;
- That operates in the configurations of firing from a helicopter, at grazing trajectory.

The need can be extended to other calibers and for firing from carriers other than helicopters, ground vehicles for example.

SUMMARY OF THE INVENTION

The aim of the invention is therefore in particular to alleviate the aforementioned drawbacks and to address the need expressed hereinabove. For this purpose, the subject of the invention is a proximity fuze able to be fitted to a projectile, said fuze having the mission of detecting an obstacle in proximity, an obstacle in proximity being defined as being an obstacle exhibiting a minimum distance from said fuze, said fuze comprising at least:

an emission device having a pupil emitting a light beam directed forward of said fuze;

a reception device having a pupil detecting the luminous fluxes in a cone directed forward of said fuze, said light beam and said cone having relative orientations such that they cross one another, the emission pupil and the reception pupil being off-centered;

a detection volume being the volume where said light beam crosses said cone so that when an obstacle is in said detection volume, the light emitted by said emission device is backscattered toward said detection device, an obstacle in proximity being detected by detecting the maximum of backscattered power, said cone for reception being centered on the axis of said fuze.

The reception pupil has for example a crescent moon shape.

In a particular embodiment, the fuze delivers a signal if at least one condition is satisfied, said condition being the detection of said maximum of backscattered power. Said signal is for example delivered if a second condition is satisfied, said second condition being that said maximum of backscattered power exceeds a given threshold. Said signal is for example able to trip the detonation of an explosive charge.

The emission beam is for example coded to allow its identification by said reception device, said light beam being for example modulated. The light beam can be produced by a laser diode or a light-emitting diode (LED).

The subject of the invention is also a projectile fitted with a fuze such as described above. In a possible embodiment, said projectile comprises a munition of medium caliber type. It is for example able to be fired from an airborne platform and/or from a ground platform.

BRIEF DESCRIPTION OF THE DRAWINGS

Other characteristics and advantages of the invention will become apparent with the aid of the description which follows given in relation to appended drawings which represent.

DETAILED DESCRIPTION

Figure 1:
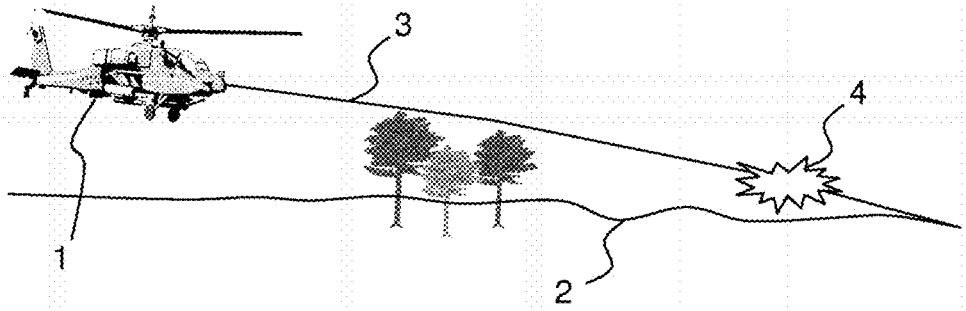
FIG. 1, an exemplary use of a device according to the invention, in the case of projectile firings from a helicopter.

FIG. 1 illustrates a case of using a device according to the invention. A helicopter 1 flying at low altitude fires a projectile fitted with a proximity fuze toward the ground 2, the medium caliber munition following a grazing firing trajectory 3. A function of the proximity detection device fitted to the munition being to allow explosion 4 of the latter at the most appropriate instant before impact on the ground, when the distance between the proximity fuze and the target becomes less than a given threshold. The aim is for the target to be detected before the projectile explodes or penetrates it. The invention can also apply in respect of firings of projectiles from other airborne platforms. It can also apply in respect of projectiles fired from ground platforms, from vehicles for example.

Figure 2A:
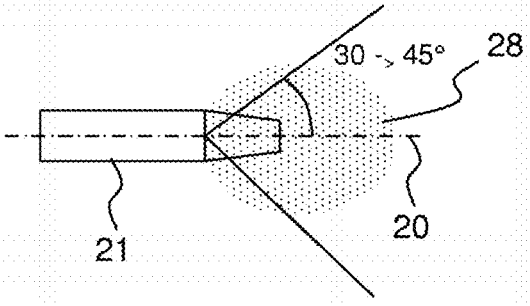
FIGS. 2*a* and 2*b*, an exemplary proximity fuze according to the prior art.
Figure 2B:
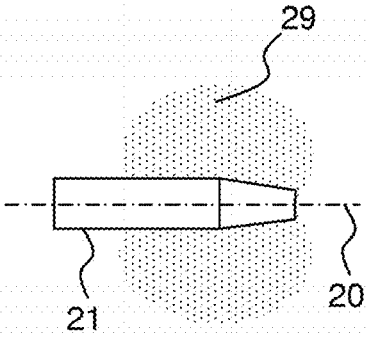

FIGS. 2*a* and 2*b* present an example of proximity fuzes 21 according to the prior art.

Proximity fuzes for mortar or artillery projectiles are designed to detect the ground by considering arrival angles of generally between 15° and 80°. FIGS. 2*a* and 2*b* present two typical configurations of the main emission lobe 28, 29 obtained on proximity fuzes based on radio frequency (RF) technology, based on electromagnetic probes of the miniaturized radar type for example. In FIG. 2*a*, the main emission lobe 28 exhibits an aperture angle of the order of 30° to 45° with respect to the axis 20 of the fuze. In FIG. 2*b* the main emission lobe 29, situated laterally, exhibits a wide angular aperture.

As mentioned previously, a medium caliber application is characterized by extremely small angles of arrival at the target (angle of incidence with respect to the ground).

The implementation of a proximity function must consequently address the need for reliable operation for arrival angles of less than a few degrees. The triggering distances, in relation to the effectiveness of the munition, also require to be greatly reduced, these distances possibly being between 0.5 meter and 1.5 meters for example.

The operation of a proximity fuze for very small angles of incidence then requires a very directional detector, stated otherwise a particularly slender emission lobe, so as in particular to avoid the risks of false alarms due to obstacles situated in proximity to the trajectory of the munition. The configurations of FIGS. 2*a* and 2*b* do not address this requirement.

In particular, as regards RF technology, increased directivity can be obtained by operating at higher working frequencies and by employing antenna arrays. However, despite these adaptations, and when operating in the KA band, obtaining aperture angles of less than 15° remains difficult to achieve. The need cannot therefore be addressed easily and at low cost by an RF solution. Moreover, it is important to note that the operation of an RF proximity fuze at such high frequencies, in addition to increased sensitivity to the environment, poses the problem of the availability of components and as a consequence that of the cost of mass production as has just been mentioned.

The performance to cost ratio of the RF solution implies that the latter is not suitable for addressing the need expressed in an optimal manner.

Figure 3:
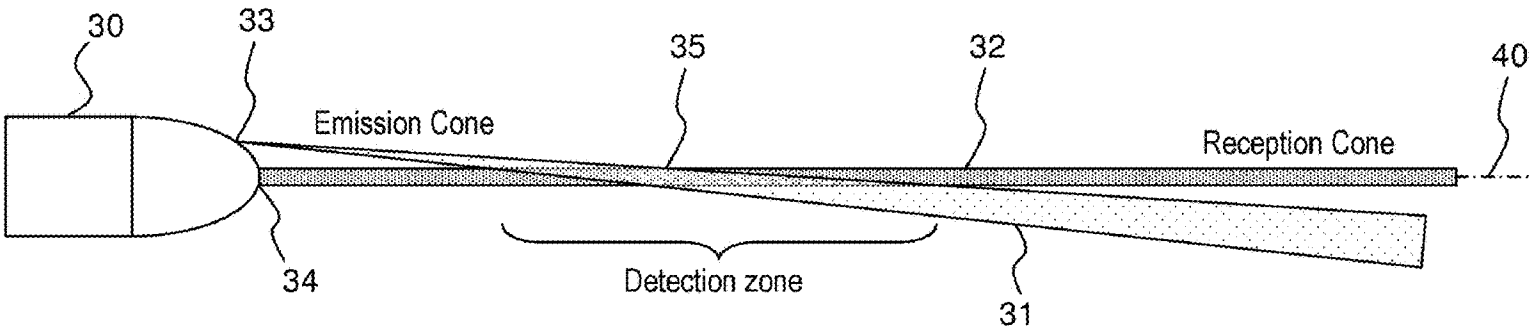
FIG. 3, an illustration of the operating principle of a proximity fuze according to the invention.

FIG. 3 illustrates the operating principle of a proximity fuze 30 according to the invention. The fuze 30 uses a laser source as emission source. More particularly, a proximity fuze according to the invention comprises in particular:

An emission device emitting a light beam 31 directed forward of the munition, the beam having the shape of a narrow cone, having an angular aperture of less than a degree;

A reception device detecting a luminous flux 32 in a narrow cone directed forward of the munition, forming a detection cone or reception cone;

Means for processing the signals received.

The power emitted is advantageously of the order of a few milliwatts.

The pupil 33 for emission and the pupil 34 for reception are separated in such a way in particular that the two cones 31, 32 cross one another in front of the munition. The detection volume is the volume 35 where the light beam 35 is in the reception cone 34. This volume is advantageously centered on the axis 40 of the munition, the axis common to the fuze.

When the munition approaches initially the spot of the emission on the obstacle is outside the reception cone 32. There is no detected signal.

Next, with the obstacle approaching, the spot on the obstacle enters the reception field. The signal increases with the increase in the fraction of the spot in the the reception cone 32.

The spot of the emission on the obstacle enters the detection zone. The fraction of the spot of the emission on the obstacle increases as the munition approaches. When the whole spot is in the reception cone 32 the backscattered flux to be detected grows as the inverse of the square of the distance to the obstacle.

Finally the spot of the emission on the obstacle exits the reception cone 32 progressively. The detected flux decreases rapidly when the emission cone 31 exits the reception cone 32. This passage through a maximum of the detected flux is the temporal marker of proximity of the obstacle.

Figure 4A:
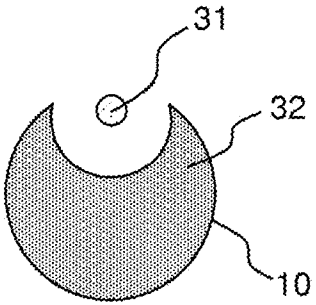
FIGS. 4*a* and 4*b*, an illustration of a possible embodiment of a fuze according to the invention.
Figure 4B:
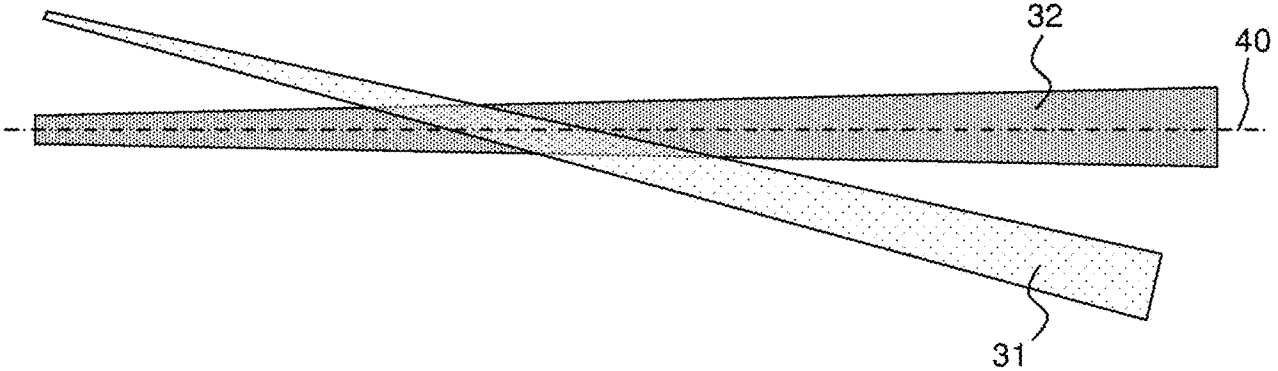

FIGS. 4*a* and 4*b* illustrate more precisely a possible embodiment corresponding to the example of FIG. 3. The emission pupils and the reception pupils are represented in FIG. 4*a* by a sectional view of the emission cone 31 and reception cone 32, in proximity to the pupils. This FIG. 4*a* shows that the emission and reception pupils are off-centered. More precisely the reception pupil has a crescent moon shape inscribed in a circle 10, the emission pupil is situated outside this crescent, centered on the intersection of the axis of symmetry of the crescent and of the circle 10. The emission pupil 31 may be situated somewhere else with respect to the crescent, while being off-centered with respect to the latter. As shown by FIG. 4*b*, the emission cone 31 and reception cone 32 cross, these being represented by a longitudinal sectional view, the emission cone 31 entering the reception cone in front of the munition.

Figure 5:
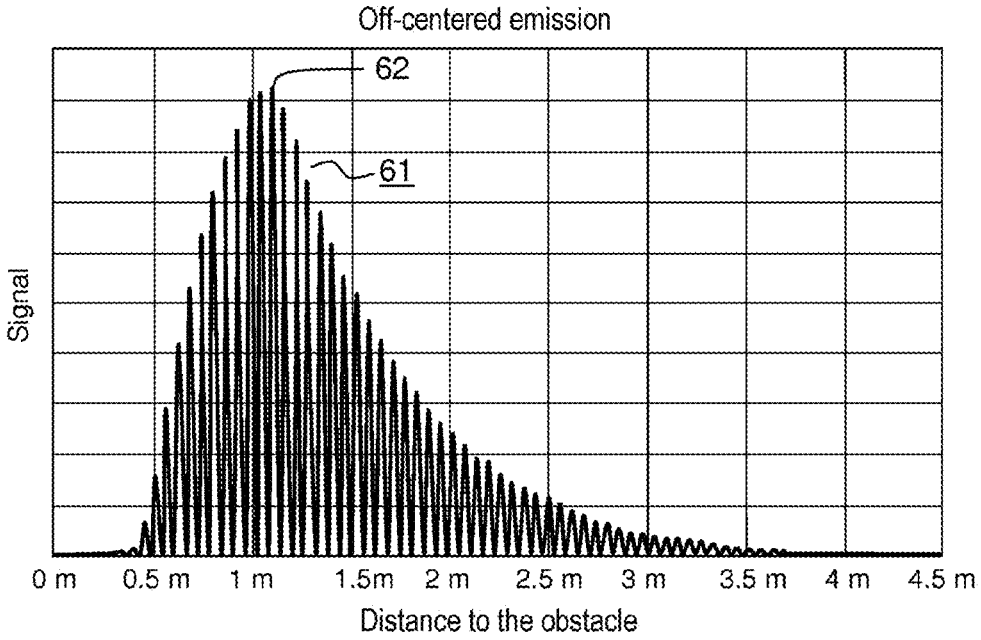
FIG. 5, the profile of a received signal.

FIG. 5 illustrates the detection principle set forth hereinabove corresponding in particular to the exemplary embodiment of FIGS. 4*a* and 4*b*. The power of the received signal along the ordinate is dependent on the distance from the target, along the abscissa.

A curve 61 represents the received signal in the case of a modulated emitted signal. Passage to the maximum 62 of power received serves as marker of distance from the obstacle.

In this case, at large distance from the obstacle or from the target, the reception pupil collects the flux backscattered by the obstacle illuminated by the emission beam 31. On approaching, the signal increases as a function of the inverse of the square of the distance of the munition from the obstacle. Next the signal reaches a maximum 62 when the backscattered flux no longer reaches the whole of the reception pupil in the reception field. Thereafter, the signal decreases rapidly until the emission spot is no longer visible by the reception pupil.

The signals received are for example digitized and analyzed by the processing means.

Figure 6:
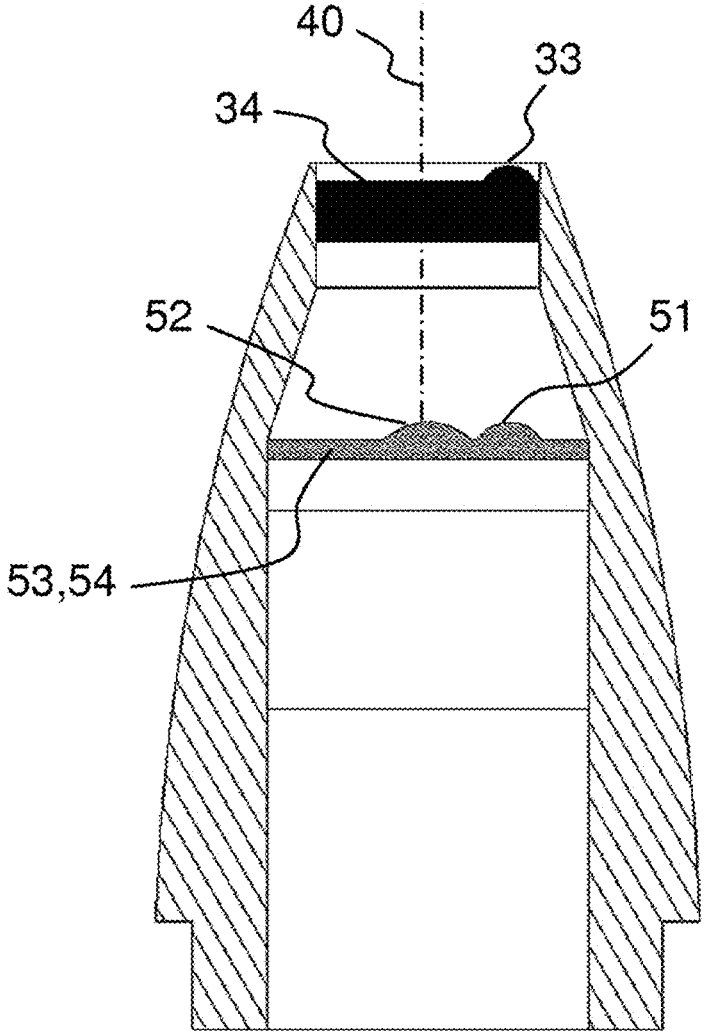
FIG. 6, an exemplary embodiment of a fuze according to the invention.

FIG. 6 presents a preferential embodiment of a proximity fuze according to the invention. It comprises:

An emitter with laser diode 51, producing a luminous emission of small divergence, the pupil 33;

A receiver 52 carrying out a mono-detection element, the cone of which is narrow, a few milliradians for example, observing forward of the fuze precisely in the direction of travel of the munition, preferably the pupil 34 is centered in the front of the fuze and in all cases separated from the emission pupil 33.

The alignment of the axis of the reception cone 32 on the axis 40 of the munition advantageously allows the luminous flux coming from the obstacle illuminated by the ambient light to vary slowly despite the rotation of the munition, thereby facilitating the detection of the emission on the obstacle. Also, the emitted power can thus advantageously be reduced. The detection of the receiver is synchronous with the emission. The direction of emission crosses the reception cone, not necessarily on the axis of the munition. The emission is for example coded and modulated to facilitate its identification by the receiver.

The emitter is for example placed on a first printed circuit 53 whose plane is perpendicular to the axis 40 of the fuze. The emitter is for example placed in an off-centered position so as to cross the emission and reception beams as illustrated by FIG. 3. The first printed circuit comprises for example the means for coding or modulating the emitted wave.

The receiver 52 is for example mounted on a second printed circuit 54 whose plane contains the axis 40 of the fuze. The receiver 52 is for example positioned on this axis 40, toward the front in accordance with the centered position of the pupil 34. The second printed circuit 54 comprises for example the processing means. These processing means detect in particular an obstacle in proximity in accordance with the procedure described in FIG. 4. In particular, the processing means receive from the receiver the received signal digitized according to an appropriate sampling frequency. The signals received are for example digitized inside the receiver which performs the digital conversion of the received-signal power. On the basis of these digitized data, the processing means detect the maximum. When this maximum is detected, the processing means dispatch for example a signal to activate the explosion of the charge carried by the projectile fitted with the proximity fuze according to the invention. Detection of the maximum makes it possible to circumvent the variations of the level of the received signal because of the nature of the obstacle. A bright obstacle will return more light than a dim obstacle. The maximum is at a fixed distance from the munition on account of the relative geometry of the emission cone 31 and of the reception cone 32.

A threshold for the level of power received can be combined with the detection of the maximum of power received. This is in order to avoid triggering on overly weak signals of parasitic origin.

The invention can also be integrated as proximity function, in any munition fuze, including in configurations of indirect firing, such as for artillery or mortar. It is also suitable for all types of calibers.

The invention claimed is:

1. A proximity fuse configured to be fitted to a projectile and to detect an obstacle in proximity of the projectile, said fuse having a longitudinal axis and comprising:

an emission device having an emission pupil configured to emit a light beam directed forward of said fuse, a reception device having a reception pupil configured to detect luminous fluxes in a reception cone directed forward of said fuse, said light beam and said reception cone having relative orientations such that the light beam and the reception cone cross one another, the emission pupil and the reception pupil being off-centered, wherein the reception device is configured to detect the obstacle in a detection volume where said light beam crosses said cone and light from the light beam emitted by said emission device is backscattered toward said detection device, said reception device is configured to detect a maximum of backscattered power, and said reception cone is centered along the longitudinal axis of said fuse.

2. The proximity fuse of claim 1, wherein the reception pupil has a crescent moon shape.

3. The proximity fuse of claim 1, wherein the reception device is configured to deliver a signal based on said maximum of backscattered power.

4. The proximity fuse of claim 3, wherein said signal is delivered based on said maximum of backscattered power exceeding a threshold.

5. The proximity fuse of claim 3, wherein said signal is configured to trip a detonation of an explosive charge.

6. The proximity fuse of claim 1, wherein the emission beam is coded for identification by said reception device.

7. The proximity fuse of claim 6, wherein said light beam is modulated.

8. The proximity fuse of claim 1, wherein the light emission includes a laser diode or a light-emitting diode configured to emit the light beam.

9. A projectile comprising a proximity fuse of claim 1.

10. The projectile of claim 9, wherein the projectile comprises a munition.

11. The projectile of claim 9, wherein the projectile is configured to be fired from an airborne platform.

12. The projectile of claim 9, wherein the projectile is configured to be fired from a ground platform.

* * * * *